US008040252B2

(12) United States Patent
Namikawa

(10) Patent No.: US 8,040,252 B2
(45) Date of Patent: Oct. 18, 2011

(54) APPARATUS, PROGRAM AND STORAGE MEDIUM FOR NOTIFYING INTERSECTION INFORMATION

(75) Inventor: Yutaka Namikawa, Obu (JP)

(73) Assignee: DENSO Corporation, Kariya (JP)

( * ) Notice: Subject to any disclaimer, the term of this patent is extended or adjusted under 35 U.S.C. 154(b) by 286 days.

(21) Appl. No.: 12/320,951

(22) Filed: Feb. 10, 2009

(65) Prior Publication Data

US 2009/0212973 A1 Aug. 27, 2009

(30) Foreign Application Priority Data

Feb. 22, 2008 (JP) ..... 2008-041343

(51) Int. Cl.
*G08G 1/00* (2006.01)

(52) U.S. Cl. ..... 340/901; 116/63 R; 40/612

(58) Field of Classification Search ..... 340/901, 340/904, 905, 907, 909, 916, 917, 918; 116/63 R; 40/612

See application file for complete search history.

(56) References Cited

U.S. PATENT DOCUMENTS

| | | | | |
|---|---|---|---|---|
| 6,262,673 | B1 * | 7/2001 | Kalina | 340/901 |
| 6,985,073 | B1 * | 1/2006 | Doan | 340/425.5 |
| 6,985,079 | B1 * | 1/2006 | Pinter et al. | 340/575 |
| 6,989,766 | B2 * | 1/2006 | Mese et al. | 340/907 |
| 2003/0063015 | A1 * | 4/2003 | Ebner et al. | 340/907 |
| 2007/0010944 | A1 * | 1/2007 | Ferrebee et al. | 701/301 |
| 2008/0088479 | A1 * | 4/2008 | Caminiti et al. | 340/932 |
| 2009/0224942 | A1 * | 9/2009 | Goudy et al. | 340/905 |

FOREIGN PATENT DOCUMENTS

| | | |
|---|---|---|
| JP | A-11-272992 | 10/1999 |
| JP | A-2002-163767 | 6/2002 |
| JP | A-2006-155319 | 6/2006 |
| JP | A-2006-285732 | 10/2006 |
| JP | A-2007-255919 | 10/2007 |

* cited by examiner

*Primary Examiner* — George Bugg
*Assistant Examiner* — Edny Labbees
(74) *Attorney, Agent, or Firm* — Posz Law Group, PLC

(57) ABSTRACT

A signal sequence of a traffic signal is notified for a driver of a vehicle that is heading for an intersection by using a signal sequence notification apparatus. If the apparatus determines, based on received signal sequence information, that the information indicates that the traffic signal is currently allowing an entrance into the intersection having the next signal sequence indicating that entrance is not allowed with no right turning permission, the driver receives warning about the entrance into the intersection. The warning thus decreases the possibility of the vehicle to be brought to a standstill in the intersection due to the traffic signal that has a signal sequence of no right/left turn by the right/left turn light after a signal change from GO to STOP regarding the straight traffic.

7 Claims, 6 Drawing Sheets

| INT ID | POS | FLAG | DIR |
|---|---|---|---|
| A | EL P, NL Q | OFF | |
| B | EL S, NL T | ON | S, N |
| C | EL X, NL Y | ON | SSE |

APPARATUS, PROGRAM AND STORAGE MEDIUM FOR NOTIFYING INTERSECTION INFORMATION

CROSS REFERENCE TO RELATED APPLICATION

The present application is based on and claims the benefit of priority of Japanese Patent Application No. 2008-41343, filed on Feb. 22, 2008, the disclosure of which is incorporated herein by reference.

FIELD OF THE DISCLOSURE

The present disclosure generally relates to a signal sequence information notification apparatus for use in a vehicle.

BACKGROUND INFORMATION

Conventionally, a technique for displaying signal sequence information of a subject traffic signal beyond a scope of a current signal sequence that can be viewed by a driver who is heading for an intersection having the subject traffic signal is disclosed, for example, in Japanese patent documents JP-A-2006-155319 and JP-A-H11-272992.

In the disclosure of the above patent documents, a technique addresses a problem regarding a right turn at an intersection in the left-side traffic system (a right-left relationship may be reversed for the right-side traffic system). The addressed problem is that, when a driver of a vehicle is waiting for a right turn at a center portion of the intersection, he/she in wait fails to notice a change of traffic signal from allowing the entrance into the intersection to not allowing for an on-coming traffic. In other words, when the driver fails to notice a transition of the traffic signal changing from Green to Red through Yellow, he/she may be left to a standstill at the center of the intersection, due to a loss of an appropriate right-turning timing.

The inventor of the present disclosure has noticed that, at some intersection, a right turn light disposed in a certain traffic signal for permitting right turning at the intersection (e.g., a right arrow shape light) is not lighted (i.e., is not turned on) after a change of the traffic signal from GO (i.e., Green light) to STOP (i.e., Red light) for a straight traffic that passes straight through the intersection. That is, in this case, an expected signal sequence is different from the actual sequence.

In the above intersection, the possibility of a vehicle to enter the intersection having an expectation and a hasty conclusion of the driver that the traffic signal sequence currently changing from GO to STOP for the straight traffic is followed by the right turn light being turned on in the next signal sequence for allowing/permitting the right-turning of the vehicle is increased, with the vehicle brought to a standstill at the center of the intersection while attempting the right turning in vain.

SUMMARY OF THE DISCLOSURE

In view of the above and other problems, the present disclosure provides a technique that decreases the possibility of the vehicle to be brought to a standstill at an intersection that has an attention-required traffic signal that has a problem causing signal sequence.

In an aspect of the present disclosure, an intersection information notification apparatus for use in a vehicle includes: a receiver for receiving information regarding a signal sequence of a traffic signal that is disposed at an intersection; and a warning unit for providing a warning that warns a driver of the vehicle of entrance into the intersection under a circumstance that (a) the vehicle is traveling toward the traffic signal in line with a signaling direction of the traffic signal, and (b) a current signal sequence of the traffic signal indicates that a current signal is allowing entrance into the intersection with a subsequent signal not allowing entrance into the intersection and not allowing a turn at the intersection.

In the above-described manner of warning provision, the intersection information notification apparatus can provide warning for the driver of the vehicle, based on a determination derived from received signal sequence information of the traffic signal, that the traffic signal will indicate no entrance for the intersection with no permission of right turning in the next signal sequence after indicating in the current signal sequence that the entrance into the intersection is allowed. In other words, the intersection information notification apparatus predicts that the traffic signal (i.e., an attention-required traffic signal) will not permit the right turning for the vehicle after the change of the signal sequence from GO to STOP in the currently approaching intersection, thereby providing an advance notification, that is, a warning that warns the driver about the entrance into the intersection. As a result, a warning for the attention-required traffic signal is provided for the driver of the vehicle in an appropriate timing when the vehicle is approaching the attention-required traffic signal.

The driver having the warning thus drives the vehicle with caution and prudence in entering the intersection, thereby decreasing the possibility of the standstill of the vehicle in the intersection caused by the attention-required traffic signal.

In another aspect of the present disclosure, the above-described apparatus of the present disclosure may also be provided as a program product that controls a computer to be serving as the intersection information notification apparatus.

Further, the above-described apparatus may further be provided as a storage medium that stores the traffic signals having the right turn light in addition to the GO/STOP lights with the above-described signal sequence (i.e., the attention-required traffic signal) in a distinguishable manner from other traffic signal.

BRIEF DESCRIPTION OF THE DRAWINGS

Objects, features, and advantages of the present disclosure will become more apparent from the following detailed description made with reference to the accompanying drawings, in which.

DETAILED DESCRIPTION

First Embodiment

Figures 1, 2:
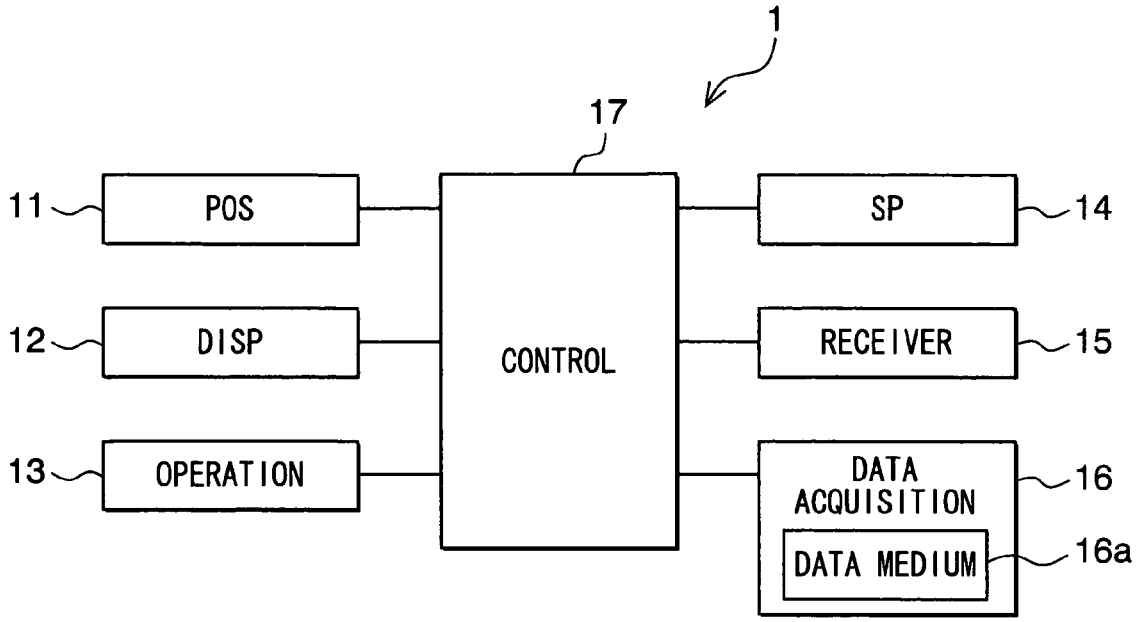
FIG. 1 is a block diagram of a navigation apparatus 1 for use in a vehicle according to a first embodiment of the present disclosure.
FIG. 2 is a diagram that illustrates a data structure of node data in road data.

The first embodiment of the present disclosure is described in the following. FIG. 1 shows the hardware configuration of a navigation apparatus 1 (Correspond to an example of the intersection information notification apparatus) for use in a vehicle according to the present embodiment. The navigation apparatus 1 for use in the vehicle has a positional detector 11, a display unit 12, an operation unit 13, a speaker 14, a traffic information receiver 15, a map data acquisition unit 16, and a control unit 17.

The positional detector 11 includes various sensors such as a geo-magnetism sensor, an acceleration sensor, a gyroscope, a speed sensor, and a GPS receiver, each of which are well-known (not illustrated in the figure), and outputs vehicle information such as a current location, a traveling direction, a traveling speed and the like to the control unit 17 based on the featured functions of those sensors.

The display unit 12 displays, for the user, various images based on image signals output from the control unit 17. The images include, for example, a current position map that maps the current location of the vehicle with its surrounding areas.

The operation unit 13 includes input device such as multiple pieces of mechanical switches on the navigation apparatus 1, a touch panel installed on the display surface of the display unit 12, and outputs, to the control unit 17, a signal according to a press-down of the mechanical switches by the user and a touch of the user on the touch panel.

The traffic information receiver 15 is a wireless receiver that receives information such as congestion information, traffic regulation/restriction information and the like transmitted by multiple road-side stations along the road or by FM radio broadcasting stations, which are to be output to the control unit 17. For instance, a VICS receiver ('VICS' stands for a traffic information service in Japan.) is used as the receiver 15.

Further, the receiver 15 receives, from the road-side station, traffic signal information regarding each of multiple traffic signals around the road-side station, and outputs the information to the control unit 17. The information of a specific traffic signal includes, an identification information of the traffic signal, an intersection identification information regarding the intersection where the traffic signal is disposed (i.e., an intersection ID), location information on the location of the intersection (i.e., latitude and longitude), signal direction information regarding which direction the traffic signal faces, and signal sequence information that indicates transition of signal sequences of the specific traffic signal (i.e., sequence information).

The signal direction information is the information representing from which direction of vehicle traffic the traffic signal is facing and controlling. For instance, when a certain traffic signal is controlling a traffic that runs from South to North to enter into the intersection at which the certain traffic signal is disposed, the direction information of the traffic signal indicates that the traffic signal is facing South. The controlling of the traffic means that the traffic signal either allows a vehicle to enter into the intersection, does not allow the vehicle to enter into the intersection, or the like.

Further, the signal sequence information on the traffic signal contains information that shows a displayed content of the current signal sequence, the next signal sequence, and the post-next signal sequence. When the traffic signal has GO/STOP lights only that represent that entrance into the intersection is either allowed, not allowed by using green, red, and yellow lights (i.e., the first signal unit in claim language), the signal sequence information includes the information on the GO/STOP lights, that is, the information on the entrance into the intersection being allowed/not allowed associated with the GO/STOP lights.

Further, if the traffic signal has the turn lights such as right turn light (corresponding to a left turn light (in an arrow shape) for allowing left turning posterior/prior to the straight traffic through the intersections in the United States) in addition to the GO/STOP lights for overridingly controlling the straight traffic that is under control of the GO/STOP lights (i.e., the second signal unit in claim language), the information on the displayed content further includes right turn light information, that is, the information on right turning being allowed in the intersection or not.

Further, the signal sequence information may contain information on the change timing of the displayed contents, that is, when the traffic signal is changed from the current signal sequence to the next sequence, the next to post-next sequence or the like.

The map data acquisition unit 16 includes device that reads/writes (when it is possible) data from/to nonvolatile map data storage media **16*a* such as DVD, CD, HDD and the like. The map data storage medium 16*a* memorizes a program executed by the control unit 17**, map data for route guidance and the like.

The map data includes road data and facilities data. The road data has information related to the interconnection of a node (i.e., an intersection) and a link. Further, the road data has, for each of the multiple links, identification information of the link, location information of the link, information on the number of lanes and lane locations in the link.

Further, the road data has, for each of the multiple nodes, identification information of the node (i.e., an intersection ID), location information of the node, a complex flag of the node, and direction information of the complex flag as illustrated in FIG. 2.

The complex flag has either of two values, that is, on and off. The complex flag shows that at least one or more attention-required signals are set up in the intersection when it is on, and shows that the attention-required signal is not set up in the intersection when it is off.

The attention-required signal is a traffic signal having the turn light in addition to the GO/STOP lights, and the signal sequence of the attention-required signal changes in the following manner. That is, the right turn light indicates that the right turning not allowed when the GO/STOP lights has changed from the entrance into the intersection being allowed to being not allowed, and after a certain period of time (e.g., a time for allowing the entrance of the crossing traffic in to the intersection), the next sequence of the right turn light allows the right turning with the GO/STOP lights of straight traffic kept unchanged in the entrance-not-allowed condition. (The 'right turn' always corresponds to the left turn at the intersection in US.)

Usually, when the traffic signal having the right turn light in addition to the GO/STOP lights has changed from the entrance not allowed to the entrance being allowed (i.e., the light has changed from the green to yellow, then to red), the right turn light allows the right turning of the traffic at the same time. Therefore, it is likely for the driver of the vehicle to enter into the intersection to start turning by a hasty conclusion. In that case, the vehicle may be brought to a standstill right at the center of the intersection. Or, when the vehicle is traveling at a high speed with the driver's intention for going into and turning/passing the intersection, the vehicle may not be able to stop before entering into the intersection if the GO/STOP lights changes from allowing to not-allowing the entrance together with the right turn light not allowing right turning.

The direction information corresponding to the complex flag is information on the facing direction of at least one traffic signal in a certain intersection. That is, in which direction each of the at least one traffic signal is facing at the intersection. In other words, the existence of the attention-required signal is distinguished from other traffic signals and is memorized in the road data that is stored in the map data storage medium 16*a*.

The control unit 17(correspond to the computer in the claim language) is a microcomputer that has CPU, RAM (i.e., VRAM, SRAM or DRAM), ROM and I/O, and the like. The CPU executes a program for the operation of the navigation apparatus 1 by reading the program from ROM or the map data acquisition unit 16, as well as reading and writing (if possible) the information from/to RAM, ROM, and storage medium in the map data acquisition unit 16 while executing the program. At the same time, the CPU exchanges signals with the positional detector 11, the display unit 12, the operation unit 13, the speaker 14, and the traffic information receiver 15.

More practically, the control unit 17 performs, by executing the program, processing such current location determination processing, map display processing, guidance route calculation processing, route guide processing, attention-required signal processing, and the like.

The current location determination processing is processing that determines the current location and the travel direction of the vehicle by using the technology of a well-known map matching etc. on the basis of the signal from the positional detector 11. The map display processing is processing to display on the display unit 12 the map of a specific area such as the current location of the vehicle. In this case, information used for the map display is acquired from the map data. The guidance route calculation processing is processing that accepts an input of the destination from the user through the operation unit 13, and calculates the best guidance route from the current location to the destination.

Figure 3:
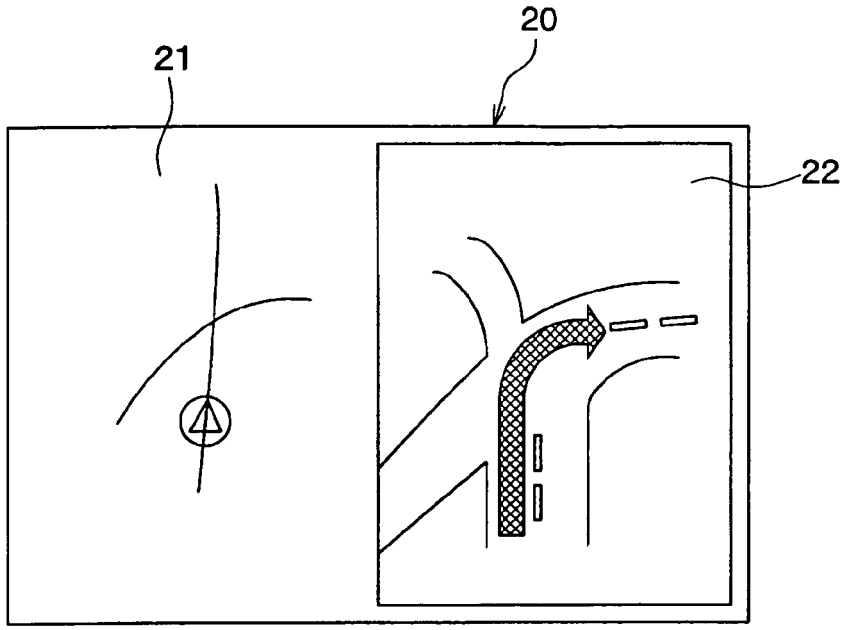
FIG. 3 is an example of a screen image displayed during route guide processing.

The route guide processing is processing for outputting guide voice from the speaker 14 to provide right/left turn instructions or the like and for displaying an expanded map of a guidance point on the display unit 12 when the vehicle approaches the guidance point of right/left turn or the like. FIG. 3 shows an example of a display image 20 that the display unit 12 displays when the route guide processing is performed. The display image 20 contains a usual map image 21 and an expanded intersection image 22 partially piled on top of the usual map image 21.

The attention-required signal processing is processing to decrease/diminish the possibility that the driver is embarrassed and/or puzzled by the attention-required signal by providing information of the intersection for the driver when the vehicle is traveling in a direction that points to the intersection having the attention-required signal with its control direction facing the vehicle.

Figure 4:
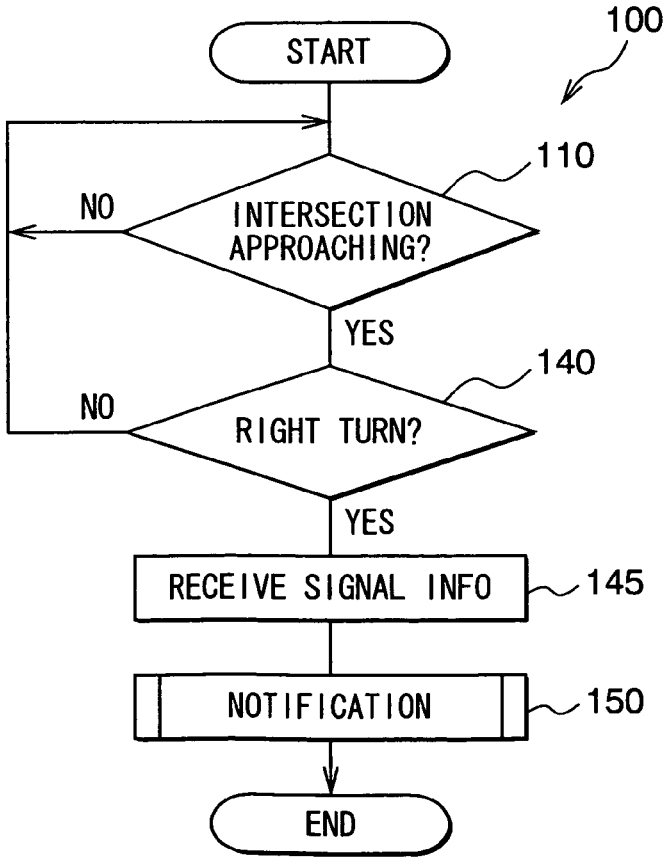
FIG. 4 is a flow chart of a program executed by a control unit.

The control unit 17 repeatedly executes a program 100 shown in FIG. 4 for performing the attention-required signal processing. While the execution of the program 100, the control unit 17 determines in step 110 whether the vehicle is approaching an intersection or not, with step 140 performed subsequently if the vehicle is approaching the intersection, or with step 110 repeated again if not approaching.

Whether the vehicle is approaching the intersection or not may be determined in the following manner. That is, when the vehicle is traveling a link that leads toward the intersection with the distance to the intersection equal to or smaller than a predetermined distance of 50 meters or the like, the vehicle is determined as approaching the intersection, or otherwise determined as not approaching.

In step 140, it is determined whether the vehicle is going to turn to the right at the approaching intersection (designated as a target intersection hereinafter). For instance, it may be determined that the vehicle is turning at the target intersection when the route guidance indicates the right turn at the target intersection under control of the route guide processing being performed. Or, alternatively, it may be determined that the vehicle is turning to the right at the target intersection when the vehicle is traveling in the right-most lane of the road based on information regarding the lanes of the road in the road data and the current vehicle location derived from the current location determination processing. If the vehicle is determined as turning to the right, step 145 is subsequently performed, or if the vehicle is determined as not turning to the right, step 110 is performed again.

In step 145, the traffic signal information regarding the facing traffic signal (designated as a target traffic signal hereinafter) in the target intersection toward which the vehicle is traveling is received by the receiver 15 from the road-side station.

Figure 5:
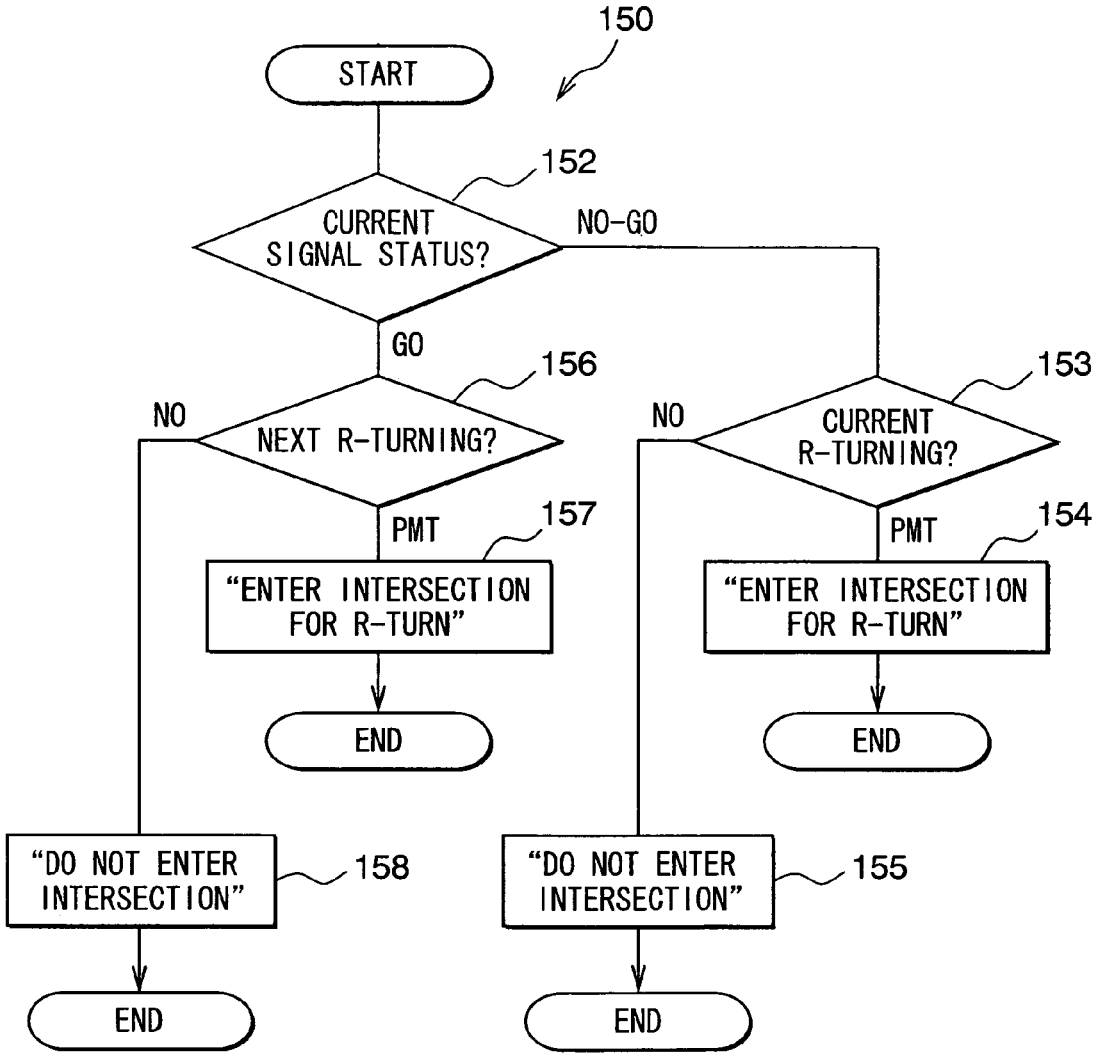
FIG. 5 is a flow chart of notification processing that shows details of the processing in step 150 in FIG. 4.

Then, in step 150, the traffic signal information (more practically, the signal sequence information) of the target traffic signal is used for notification processing. FIG. 5 shows a flow chart of details of the notification processing. In the notification processing, the control unit 17 executes step 153 if current signal status is determined as indicating the entrance is not allowed in step 152 (i.e., the yellow or red light is lighted), or executes step 156 if the signal status is determined as indicating the entrance is allowed in step 152, as illustrated in the figure.

In step 153, it is determined whether the right turn light is currently indicating that the right turning is being allowed or not. If it is determined as indicating the right turning in step 153, step 154 is subsequently performed, or if it is determined in step 153 not indicating the right turning, step 155 is performed subsequently.

Figure 6:
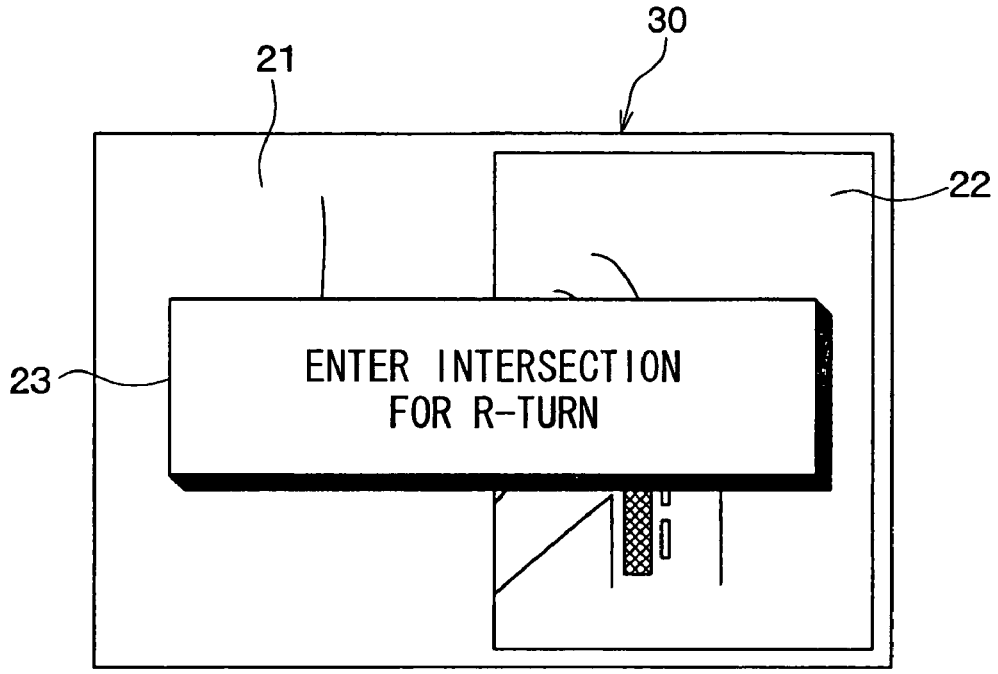
FIG. 6 is an illustration of a text message that prompts a user to enter an intersection for right turning.

In step 154, the driver is notified that the driver may enter the target intersection by guidance voice from the speaker 14 or by guidance image from the display unit 12. For instance, when the information is notified by the image, the display unit 12 displays an image 30 that has an entrance allowance display 23 that indicates that the entrance into the intersection is allowed displayed on top of the map image 21 and the expanded intersection image 22 as shown in FIG. 6. The allowance display 23 is, more practically, a text message that prompts the driver to enter the target intersection for the right turning.

Figure 7:
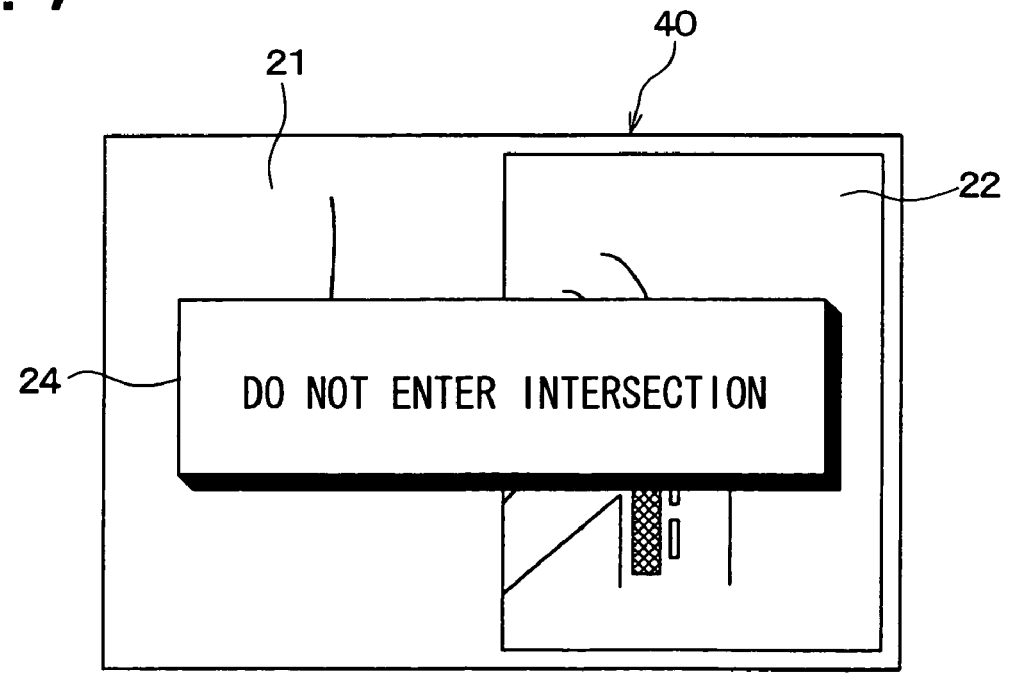
FIG. 7 is an illustration of a text message that warns the user for entrance into the intersection.

In step 155, the driver is warned by voice from the speaker 14 or by an image from the display unit 12 that the vehicle should not enter the target intersection. For instance, when the warning is provided by the image, an image 40 that has a warning display 24 on top of the map image 21 and the expanded intersection image 22 as shown in FIG. 7 is displayed on the display unit 12. The warning display 24 is, more practically, a text message that indicates that the vehicle is prohibited from entering the target intersection.

On the other hand, in step 156 that is executed when the GO/STOP lights allow the entrance into the intersection at current signal status, it is determined whether the next status (i.e., the next signal sequence) indicates the right turning is allowed by the right turn light or not. If the right turning is allowed, step 157 is subsequently executed, or if the right turning is not allowed, step 157 is subsequently executed.

In step 158, the driver is warned by voice/image in the same manner as step 155 that the vehicle should not enter the target intersection.

In step 157, the driver is notified by voice/image in the same manner as step 154 that the vehicle may enter the target intersection.

The current execution of the program 100 is concluded after steps 145, 155, 157, and 158.

As mentioned above, when the vehicle is approaching the target intersection (step 110) from a direction that faces the target traffic signal in the target intersection (step 140) for turning to the right at the target intersection, the control unit 17 receives the traffic signal information on the target traffic signal (step 145), and performs the notification processing (step 150).

In the notification processing, if the GO/STOP lights indicate that the entrance is currently not allowed (step 152) and the right turn light is currently allowing the right turning (step 153), the control unit 17 allows the entrance into the intersection (step 154). Or, if the GO/STOP lights indicate that the entrance is currently not allowed (step 152) and the right turn light is currently not allowing the right turning (step 153), the control unit 17 performs the warning displays that warns the driver not to enter the intersection (step 155). Or, if the GO/STOP lights indicate the entrance is currently allowed (step 152) and the right turn light in the next signal sequence indicates that the right turning is allowed (step 156), the control unit 17 allows the entrance into the intersection (step 157). Or, if the GO/STOP lights indicate the entrance is currently allowed (step 152) and the right turn light in the next signal sequence indicates that the right turning is allowed (step 156), the control unit 17 performs the warning displays that warns the driver not to enter the intersection (step 158).

More practically, the above-described sequences can be explained as corresponding to the following situation. For instance, if the approaching vehicle toward the intersection is going to attempt the right turning at the intersection, with the attention-required traffic signal facing in the traveling direction of the vehicle. In this situation, the control unit 17 provides the warning for the driver against the entrance of the vehicle into the intersection by performing steps of 110, 140, 145, 152, 156, and 158, while the attention-required traffic signal is indicating that the entrance is allowed. The driver may or may not follow the warning, and now it is assumed that the driver has stopped the vehicle before passing the intersection according to the warning. After the stopping of the vehicle and the next signal sequence of the attention-required traffic signal indicates that both of the entrance and the right turning are not allowed, the control unit 17 provides the warning for the driver against the entrance of the vehicle into the intersection by performing steps of 110, 140, 145, 152, 153, and 155. Further, after an elapse of certain period and the post-next signal sequence of the attention-required traffic signal indicates that the entrance is not allowed but the right turning is currently allowed, the control unit 17 prompts the driver of the vehicle to enter the intersection for the right turning by performing steps of 110, 140, 145, 152, 153, and 154.

In the above-described manner, the navigation apparatus 1 for use in the vehicle determines that the traffic signal is currently allowing the entrance into the intersection and subsequently not allowing the entrance with no right turning based on the received signal sequence information. That is, the navigation apparatus 1 determines that the situation is (a) the traffic signal is one of the attention-required signals and (b) the next sequence of the traffic signal is not going to allow the right turning (steps 152, 156), and provides the warning for the driver of the vehicle that the vehicle should not enter the intersection based on the determination of the situation (step 158).

When the driver receives the warning against the entrance into the intersection, the driver performs a cautious driving operation regarding the entrance into the intersection. Therefore, it is expected that the possibility of a standstill of the vehicle in the intersection is decreased due to the attention-required traffic signal.

Further, when the navigation apparatus 1 determines that the traffic signal is currently allowing the entrance into the intersection and subsequently not allowing the entrance with the right turning to be being allowed based on the received signal sequence information (steps 152, 156), the apparatus 1 provides the notification for the driver of the vehicle that the vehicle may enter the intersection (step 157).

Therefore, if the situation fulfills a condition that the attention-required signal is currently indicating the entrance being allowed, with subsequent status of not allowing the entrance but allowing the right turning, the vehicle is assumed to be facing a traffic signal that is not the attention-required type. Therefore, the driver is notified that the vehicle may enter the intersection, thereby enabling the driver to be comfortable about entrance and passing the intersection.

In addition, if the sequence transition time to the next signal sequence of the GO/STOP lights of the attention-required traffic signal exceeds the predetermined value at the determination in step 156, allowance of the entrance into the intersection may be notified for the driver in step 157 regardless of the display contents of the right turn light in the next sequence.

The reason of the above-described notification is that the necessity of providing the warning performed in step 157 is relatively low even when the facing traffic signal is the attention-required type due to the sufficient amount of time before transition of the GO/STOP light to the next signal sequence that does not allow the entrance. That is, in other words, by having the above-described notification scheme, the warning of the attention-required signal is provided only for the suitable situations.

Further, the predetermined value of the sequence transition time may be a fixed value that is pre-stored in the memory, or a variable value that is changed according to various conditions, or a randomly-determined value within a certain range. For instance, the predetermined value may have a value in proportion to a wait time that is calculated as an amount of time taken for the vehicle to reach the intersection in step 156. That is, the longer the wait time is, the greater the predetermined value becomes. The expected wait time for the vehicle to reach the intersection may be calculated by dividing the distance toward the intersection by the speed of the vehicle in step 156.

Second Embodiment

The second embodiment of the present disclosure is described in the following. The first embodiment and the second embodiment are different from each other with respect to a program 100' shown in FIG. 8 in place of the program 100 in FIG. 4 that is executed by the control unit 17, and with respect to the skipping of step 156 prior to step 158 after a determination that the current signal condition of the GO/STOP lights of the target signal is showing the allowance of the entrance into the intersection.

Figure 8:
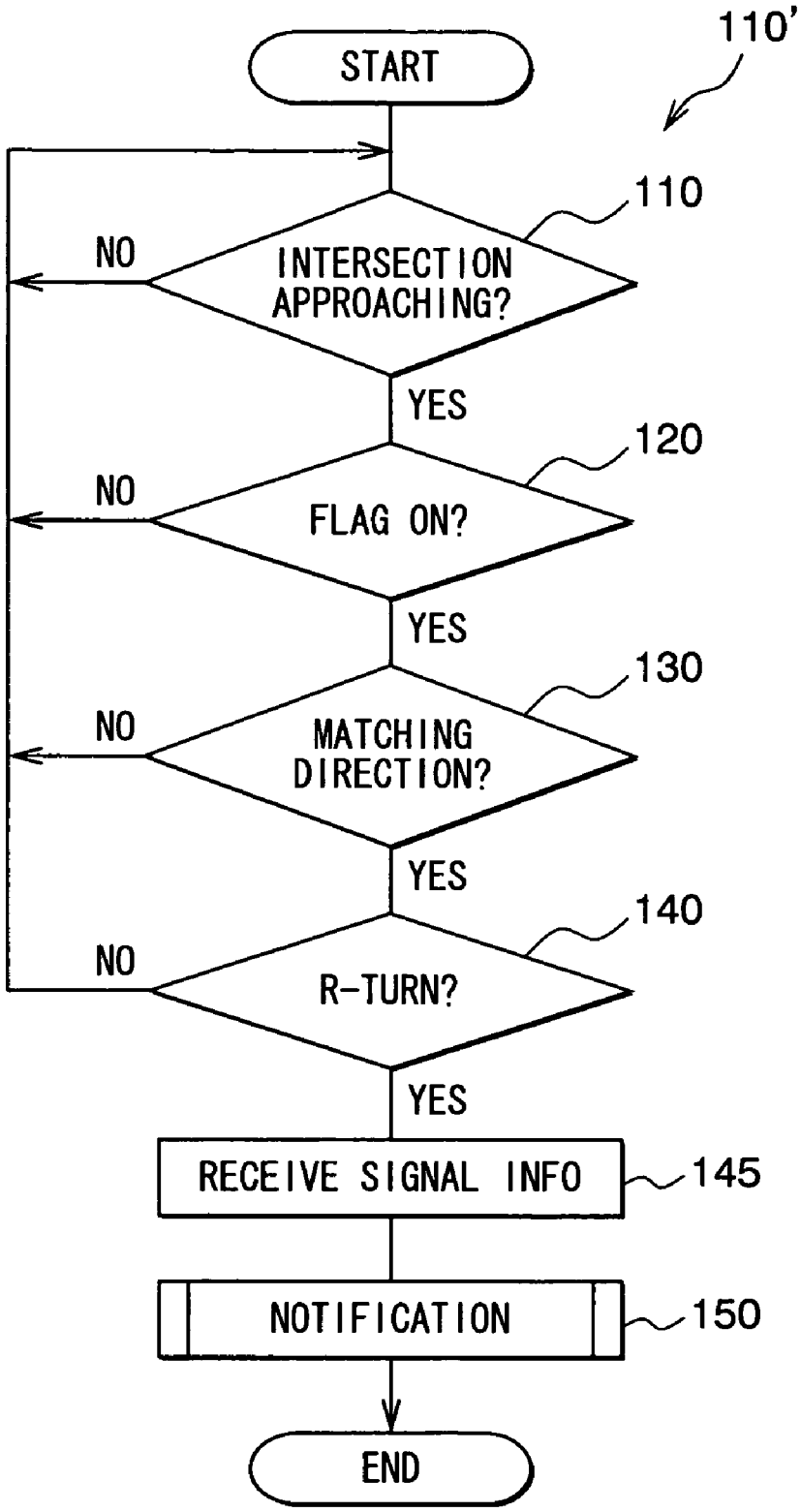
FIG. 8 is a flow chart of another program that is executed by the control unit in a second embodiment.

In both of the program 100' in FIG. 8 and the program 100 of FIG. 4, same reference numbers indicate same processing contents. In the program 100', the process proceeds from step 110 to step 120 when it is determined in the affirmative in step 110.

In step 120, it is determined whether the complex flag of the target intersection is turned on on the basis of the road data in map data storage medium 16*a*, and, if the flag is turned on, then step 130 is executed. If the flag is not turned on, then step 110 is repeated.

In step 130, it is determined whether the vehicle travels in the direction toward the target intersection corresponding to the complex flag on the basis of the road data in map data storage medium 16*a*. Then, step 140 is executed subsequently when the determination result is affirmative. If the determination result is negative, step 110 is executed again.

The navigation device 1 in the present embodiment thus warns the driver of the entrance into the intersection (step 158) when the target intersection is determined to have the attention-required traffic signal based the map data (steps 110, 120, 130) and the signal sequence is determined to be allowing the entrance into the intersection based on the signal sequence information (step 152). That is, the signal sequence information regarding the target signal in the intersection can be utilized together with the information on the attention-required traffic signal that distinguishes the attention-required traffic signals from other traffic signals.

In this case, the condition that the target traffic signal is currently allowing the entrance into the intersection and the next signal sequence indicates no-entrance and no-right turning is fulfilled when steps 120 and 130 are affirmative and step 152 determines that the signal is currently allowing the entrance into the intersection.

Third Embodiment

The third embodiment of the present disclosure is described in the following. The present embodiment differs from the previous embodiments with respect to the notification processing in step 150. More practically, the control unit 17 executes a signal transition condition display processing in step 150 in the present embodiment in place of the processing shown in FIG. 5.

The control unit 17 informs, by using voice or an image, the driver of the transition of the signal sequence of the GO/STOP lights and the right turn light in the attention-required traffic signal based on the signal sequence information of the attention-required signal received in step 145.

Figure 9:
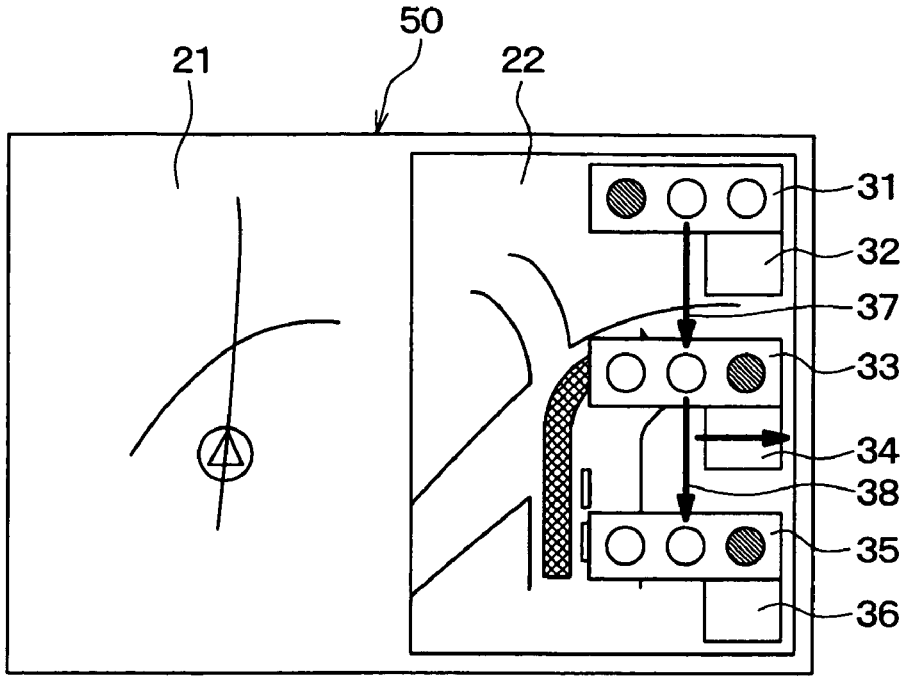
FIG. 9 is an illustration of transition of signal sequence of an attention-required traffic signal in a third embodiment.
Figure 10:
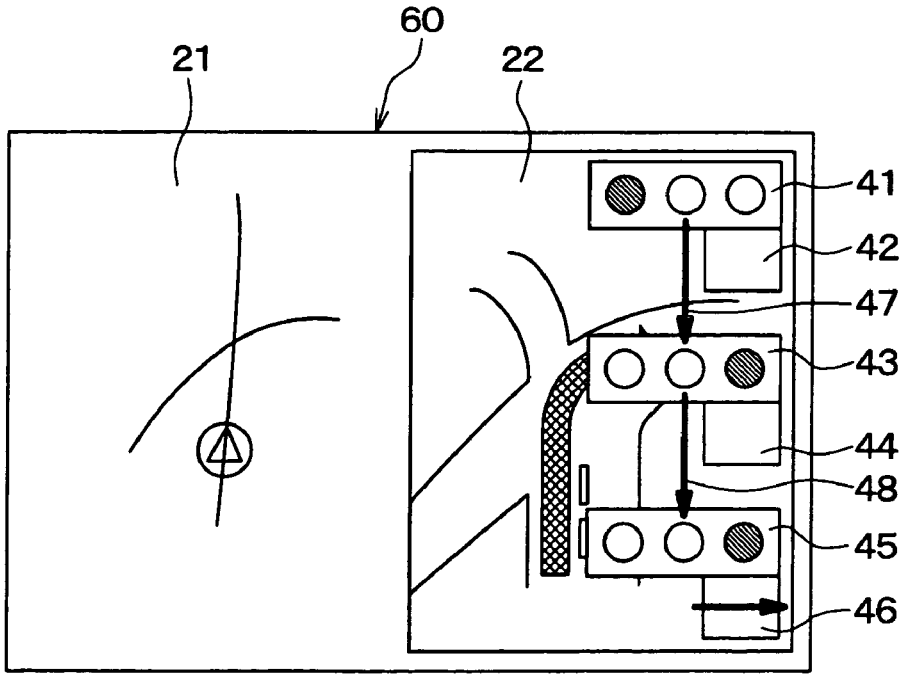
FIG. 10 is another illustration of transition of signal sequence of the attention-required traffic signal in third embodiment.

FIGS. 9 and 10 show examples of displaying the transition of the display contents of the attention-required signal by using the display unit 12. In the illustrations in FIGS. 9 and 10, the signal sequences of the attention-required signal regarding the current sequence, the next sequence and the post-next sequence are shown by the numerals 31-36 and 41-46 with the arrows 37, 38 and 47, 48 that explicitly indicate the sequence order of the signal transition from 31 to 36 and from 41 to 46.

In the example of FIG. 9, the attention-required signal shows that, in the current signal sequence, the GO/STOP lights allow the entrance into the intersection (a numeral 31), and the signal will show that, in the next signal sequence, the GO/STOP lights do not allow the entrance with the right turn light allowing the turning (numerals 33, 34), and will then show that, in the post-next signal sequence, the GO/STOP lights do not allow the entrance with the right turn light not allowing right turning (numerals 35, 36).

Further, in the example of FIG. 10, the attention-required signal shows that, in the current sequence, the GO/STOP lights allow the entrance into the intersection (a numeral 41), and the signal will show that, in the next sequence, the GO/STOP lights do not allow the entrance with the right turn. light not allowing the turning (numerals 43, 44), and will then show that, in the post-next sequence, the GO/STOP lights do not allow the entrance with the right turn light allowing right turning (numerals 45, 46).

The navigation apparatus 1 performs, as described above, the signal transition condition display processing (step 150), when the vehicle is approaching the complex intersection (steps 110, 120), in a travel direction that makes the vehicle face the attention-required traffic signal in the complex intersection (step 130), for right turning (step 140).

The navigation apparatus 1 informs the driver of the transition of the signal sequences of the attention-required signal in the above-described manner, thereby enabling the driver to have critical determination information whether or not the vehicle should enter into the intersection. As a result, the possibility of the vehicle to be brought to a standstill in the intersection due to the attention-required signal is decreased.

Fourth Embodiment

The fourth embodiment of the present disclosure is described in the following. The focus of the present embodiment is that the difference of the contents in step 150 performed by the control unit 17 as shown in FIGS. 4 and 8. More practically, the control unit 17 performs an attention calling notification in step 150 in the present embodiment in place of the processing shown in FIG. 5.

The control unit 17 performs, in the attention calling notification, a notification that calls attention for the entrance into the target intersection by voice from the speaker 14 or by an image from the display unit 12. For instance, the attention calling message may look or sound in a text message of "Warning: The approaching intersection has a complex traffic signal." either as a guidance voice from the speaker 14 or as a screen image from the display unit 12.

The navigation apparatus 1 performs, in the present embodiment, as described above, the attention calling notification (step 150), when the vehicle is approaching the complex intersection (steps 110, 120), in a travel direction that makes the vehicle face the attention-required traffic signal in the complex intersection (step 130), for right turning (step 140).

The navigation apparatus 1, thus, provides a minimum warning and/or the attention calling notification for the driver based on the complex flag of the attention-required signal in the map data without receiving the signal sequence information from outside of the vehicle, thereby enabling the decrease if the possibility of the vehicle standstill in the intersection.

Other Embodiments

Although the present disclosure has been fully described in connection with preferred embodiment thereof with reference to the accompanying drawings, it is to be noted that various changes and modifications will become apparent to those skilled in the art.

For instance, in steps 154, 155, 157, and 158 performed by the control unit 17 in the first and second embodiments, the signal transition condition display processing in the third embodiment may also be performed. In this manner, an increased amount of determination clue whether or not to enter the intersection is provided for the driver/user, in comparison to simply providing the notification of allowance/non-allowance of entrance into the intersection.

Further, in the above embodiments, the reception of the signal information of the attention-required signal is performed only after all of the steps 110 to 140 have affirmative determination results. However, the vehicle may receive the signal information of the target intersection prior to the approach of the vehicle toward the intersection. In that case, the current signal sequence of the target intersection can be determined based on the comparison between the sequence change timing in the received information and the current time.

In addition, though the above-mentioned embodiment describes the right turning situation in the left side traffic (i.e., vehicle travels on the left side of the road), the right side and left side of the road may be switched when the present disclosure is applied to the right side traffic countries such as United States and the like.

Further, each of the functions achieved by the execution of the programs by the control unit 17 in the above embodiments may also be achieved by using hardware (for instance, FPGA that can be programmed to have a circuit configuration).

Furthermore, though the navigation apparatus 1 is shown as an example of the intersection information notification apparatus in the above embodiments, other apparatus for use in a vehicle may be used as long as it is capable of providing the above-described functions of the present disclosure.

The illustrations in the present disclosure describe a traffic signal of horizontal type. However, a traffic signal of vertical type that has a vertical arrangement of the GO/STOP lights and right/left turn lights is included in the scope of the present disclosure as long as the signal sequence follows the one described in the present disclosure.

Such changes, modifications, and/or additions are to be understood as being within the scope of the. present disclosure as defined by appended claims.

What is claimed is:

1. An intersection information notification apparatus for use in a vehicle comprising:

a receiver that receives information regarding a signal sequence of a traffic signal that is disposed at an intersection;

a positional detector unit that determines the position of the vehicle relative to the traffic signal at the intersection;

a control unit that warns a user of the vehicle of a second-variety traffic signal which is different from a first-variety traffic signal, the second-variety traffic signal is a traffic signal that has a signal sequence in the following order: a first phase that allows through traffic and does not indicate turns allowed and does not indicate turns not allowed, to a second phase that does not allow through traffic and does not indicate turns allowed for a period of time to allow crossing traffic to pass through the intersection, to a third phase that does not allow through traffic and indicates turns are allowed, the control unit receives the position of the vehicle from the positional detector unit to determine whether the vehicle is approaching an intersection with a traffic signal and whether the vehicle will make a turn at the intersection;

the control unit receives the signal sequence of the traffic signal from the receiver and determines from the signal sequence whether the traffic signal is the first-variety traffic signal or the second-variety traffic signal; and wherein the control unit provides a warning to the user during the first phase and disables the warning during the third phase, to not enter the intersection because the traffic signal is a second-variety traffic signal that does not permit a turn after the first phase, when the traffic signal is the second-variety traffic signal.

2. The intersection information notification apparatus of claim 1 further comprising a non-transitory memory medium that distinguishingly memorizes the second-variety traffic signal as an attention-required traffic signal from other traffic signals, wherein the attention-required traffic signal is equipped with a first signal unit for signaling entrance and a second signal unit for signaling the turn, the second signal unit indicating no turn even after a signal change of the first signal unit from a first condition allowing entrance to a second condition not allowing entrance, wherein the control unit provides the warning that warns the driver of the vehicle of entrance into the intersection under a circumstance that (a) the traffic signal is determined as the attention-required traffic signal based on information memorized in the memory medium, and (b) a current signal sequence of the traffic signal indicates that the current signal is allowing entrance into the intersection.

3. The intersection information notification apparatus of claim 1, wherein the first-variety traffic signal is a traffic signal that has a signal sequence in this order: a first phase that allows through traffic and does not indicate turns allowed and does not indicate turns not allowed, to a second phase that does not allow through traffic and indicates turns are allowed, to a third phase that does not allow through traffic and indicates turns are not allowed; and wherein the control unit disables the warning during the first phase, the second phase, and the third phase when the traffic-signal is the first-variety traffic signal.

4. A computer program product comprising one or more non-transitory computer readable media storing computer executable instructions that implement:

receiving, in a receiver information regarding a signal sequence of a traffic signal that is disposed at an intersection;

determining, in connection with a positional detector unit, the position of the vehicle relative to the traffic signal at the intersection;

warning a user of the vehicle of a second-variety traffic signal which is different from a first-variety traffic signal, the second-variety traffic signal is a traffic signal that has a signal sequence in the following order: a first phase that allows through traffic and does not indicate turns allowed and does not indicate turns not allowed, to a second phase that does not allow through traffic and does not indicate turns allowed for a period of time to allow crossing traffic to pass through the intersection, to a third phase that does not allow through traffic and indicates turns are allowed, receiving the position of the vehicle from the positional detector unit and determining from the position of the vehicle from the positional detector unit whether the vehicle is approaching an intersection with a traffic signal and whether the vehicle will make a turn at the intersection;

receiving the signal sequence of the traffic signal from the receiver and determining from the signal sequence whether the traffic signal is the first-variety traffic signal or the second-variety traffic signal; and providing a warning to the user during the first phase, and disabling the warning during the third phase, to not enter the intersection because the traffic signal is a second-variety traffic signal that does not permit a turn after the first phase, when the traffic signal is the second-variety traffic signal.

5. A method for intersection information notification performed in an intersection information notification apparatus, comprising:

monitoring, in an intersection information notification apparatus in a vehicle, a direction and a path of the vehicle;

determining, in the intersection information notification apparatus, whether the vehicle is approaching an intersection with a traffic signal and whether the vehicle will make a turn at the intersection;

receiving, in the intersection information notification apparatus, information regarding a signal sequence of the traffic signal that is disposed at the intersection;

determining, in the intersection information notification apparatus, whether the signal sequence of the traffic signal received in the intersection information notification apparatus is a first-variety traffic signal or a second-variety traffic signal, where the second-variety traffic signal is different from the first-variety traffic signal, the second-variety traffic signal is a traffic signal that has a signal sequence in the following order: a first phase that allows through traffic and does not indicate turns allowed and does not indicate turns not allowed, to a second phase that does not allow through traffic and does not indicate turns allowed for a period of time to allow crossing traffic to pass through the intersection, to a third phase that does not allow through traffic and indicates turns are allowed; and providing a warning, from the intersection information notification apparatus, during the first phase, and disabling the warning during the third phase, to the user of the vehicle of the second-variety traffic signal and to not enter the intersection, when the traffic signal is the second-variety traffic signal.

6. The method of claim 5, wherein the first-variety traffic signal is a traffic signal that has a signal sequence in this order: a first phase that allows through traffic and does not indicate turns allowed and does not indicate turns not allowed, to a second phase that does not allow through traffic and indicates turns are allowed, to a third phase that does not allow through traffic and indicates turns are not allowed; and wherein the control unit disables the warning during the first phase, the second phase, and the third phase when the traffic-signal is the first-variety traffic signal.

7. The computer program product of claim 4, wherein the first-variety traffic signal is a traffic signal that has a signal sequence in this order: a first phase that allows through traffic and does not indicate turns allowed and does not indicate turns not allowed, to a second phase that does not allow through traffic and indicates turns are allowed, to a third phase that does not allow through traffic and indicates turns are not allowed; and wherein the control unit disables the warning during the first phase, the second phase, and the third phase when the traffic-signal is the first-variety traffic signal.

* * * * *